US010619807B1

(12) United States Patent
Flannery et al.

(10) Patent No.: US 10,619,807 B1
(45) Date of Patent: Apr. 14, 2020

(54) GATE LIGHT APPARATUS

(71) Applicant: Regalo International, LLC, Longboat Key, FL (US)

(72) Inventors: Mark A. Flannery, Longboat Key, FL (US); Gary T. Schultze, Savage, MN (US); Matthew A. Willms, Woodbury, MN (US)

(73) Assignee: Regalo International, LLC, Longboat Key, FL (US)

( * ) Notice: Subject to any disclaimer, the term of this patent is extended or adjusted under 35 U.S.C. 154(b) by 0 days.

(21) Appl. No.: 16/041,784

(22) Filed: Jul. 21, 2018

Related U.S. Application Data

(60) Provisional application No. 62/540,290, filed on Aug. 2, 2017.

(51) Int. Cl.

| | |
|---|---|
| ***F21S 8/00*** | (2006.01) |
| ***F21V 17/16*** | (2006.01) |
| *F21V 23/04* | (2006.01) |
| *F21W 131/301* | (2006.01) |
| *E06B 9/00* | (2006.01) |
| *F21Y 115/10* | (2016.01) |
| *F21V 15/01* | (2006.01) |

(52) U.S. Cl.
CPC ..... *F21S 8/036* (2013.01); *F21V 17/16* (2013.01); *E06B 2009/002* (2013.01); *F21V 15/01* (2013.01); *F21V 23/0442* (2013.01); *F21W 2131/301* (2013.01); *F21Y 2115/10* (2016.08)

(58) Field of Classification Search
CPC ..... F21S 8/036; F21S 8/081; F21V 17/16; F21V 15/01; F21V 23/0442; F21Y 2115/10; F21W 2131/301; F16M 13/022
USPC ..... 248/213.2, 214, 215, 227.4, 229.16; 362/127, 130, 152, 145, 133, 147, 396
See application file for complete search history.

(56) References Cited

U.S. PATENT DOCUMENTS

| | | | | |
|---|---|---|---|---|
| 1,337,867 | A * | 4/1920 | Whitaker | F21S 8/00 248/214 |
| 4,227,667 | A * | 10/1980 | Dickerson | A61M 5/1415 24/339 |
| 4,998,277 | A * | 3/1991 | Rioux, Jr. | H04M 1/04 248/214 |
| 5,181,774 | A * | 1/1993 | Lane | B62J 6/02 224/421 |
| 6,079,157 | A * | 6/2000 | Hincher, Sr. | E06B 9/04 362/152 |
| 6,114,963 | A * | 9/2000 | Blake | G08B 21/0202 340/521 |
| 7,722,207 | B2 * | 5/2010 | Bennette | F21V 21/002 359/591 |
| 8,459,823 | B1 * | 6/2013 | Steele | F21V 33/006 362/145 |
| 9,641,954 | B1 | 5/2017 | Typrin et al. | |
| 9,652,976 | B2 | 5/2017 | Bruck et al. | |
| 2002/0194786 | A1 * | 12/2002 | Hincher, Sr. | E06B 9/04 49/463 |
| 2006/0092378 | A1 * | 5/2006 | Marsden | E06B 9/04 352/221 |

(Continued)

*Primary Examiner* — Christopher Garft

(57) ABSTRACT

The present gate light apparatus includes an adapter bracket having a front side and a rear side. On the front side, the bracket engages a housing having a motion detector, photo sensor, and light source. On the rear side, the bracket engages two support members of a gate.

15 Claims, 17 Drawing Sheets

(56) References Cited

U.S. PATENT DOCUMENTS

| | | | | |
|---|---|---|---|---|
| 2013/0333185 | A1* | 12/2013 | Adams | F16M 13/02 29/428 |
| 2015/0061859 | A1 | 3/2015 | Matsuoka et al. | |
| 2015/0350031 | A1 | 12/2015 | Burks et al. | |
| 2016/0245501 | A1* | 8/2016 | Dunn | F21V 33/0004 |

* cited by examiner

GATE LIGHT APPARATUS

This application claims the benefit under 35 U.S.C. 119(e) of U.S. Provisional Patent Application No. 62/540,290 filed Aug. 2, 2017, which application is hereby incorporated by reference in its entirety into this application.

FIELD OF THE INVENTION

The present invention relates to a gated barrier, particularly to a gated barrier having a light, and specifically to a bracket that is engagable to a gate of the gated barrier and includes a light that can cast light on the gate or an area adjacent to the gate.

BACKGROUND OF THE INVENTION

A gate is often a temporary structure in a house. A gate is often employed in one passageway at one time and then moved to a second passageway. A husband may move a gate without telling his wife, and the wife may encounter the gate in the middle of the night. A wife may move a gate without telling her husband, and the husband may encounter the gate in the middle of the night.

Even if a person knows where a gate is, and even where a person has opened and closed such a gate many times during the day, and even if such a person is active and young, such a person can have challenges in the dark, such as the distance covered by walking, such as a coordination between the hands and the eyes, or such as a coordination between two hands.

SUMMARY OF THE INVENTION

A feature of the present invention is a gate light apparatus.

Another feature of the present invention is a gate light apparatus that connects to first and second support members disposed at an angle relative to each other.

Another feature of the present invention is the provision in such a gate light apparatus, of a bracket having a rear side and a front side.

Another feature of the present invention is the provision in such a gate light apparatus, of the rear side having a first receiver configured to engage the first support member and a second receiver configured to engage the second support member.

Another feature of the present invention is the provision in such a gate light apparatus, of a front side configured to engage a housing, the housing having a motion detector, a photo sensor, a light source, and a power source.

Another feature of the present invention is the provision in such a gate light apparatus, of the first receiver including a first axis, and of the second receiver including a second axis, where the first and second axis are set at an angle relative to each other.

Another feature of the present invention is the provision in such a gate light apparatus, of the first receiver including a first axis, and of the second receiver including a second axis, where the first and second axis are set at a right angle relative to each other.

Another feature of the present invention is the provision in such a gate light apparatus, of the housing including a base and a cover engaged inwardly of the base, where the front side is configured to engage the base without engaging the cover such that the cover is removable from the base without removing the housing from the adapter.

Another feature of the present invention is the provision in such a gate light apparatus, of the bracket including an open pocket that engages the housing, where the open pocket includes a base, opposing side arms extending frontwardly of the base and having inwardly turned ridges, and a cradle extending frontwardly of the base, and where the cradle is spaced from the side arms.

Another feature of the present invention is the provision in such a gate light apparatus, of the open pocket including an upper end closeable by a flexible barb extending forwardly and being resiliently flexible rearwardly of a front face of the base.

Another feature of the present invention is the provision in such a gate light apparatus, of the first receiver being configured to receive a support member having a cylindrical cross section and the second receiver being configured to receive a support member having a rectangular cross section.

Another feature of the present invention is the provision in such a gate light apparatus, of the first receiver being configured to receive a support member having a rectangular cross section and the second receiver being configured to receive a support member having a cylindrical cross section.

Another feature of the present invention is the provision in such a gate light apparatus, of the first receiver being configured to receive a support member having a cylindrical cross section and the second receiver being configured to receive a support member having a cylindrical cross section.

Another feature of the present invention is the provision in such a gate light apparatus, of the first receiver being configured to receive a support member having a rectangular cross section and the second receiver being configured to receive a support member having a rectangular cross section.

Another feature of the present invention is the provision in such a gate light apparatus, of the motion detector including a sensing portion having a distal end disposed inwardly of a plane of a surface of the housing.

Another feature of the present invention is the provision in such a gate light apparatus, of the photo sensor including a distal end disposed adjacent to a plane of a surface of the housing.

Another feature of the present invention is the provision in such a gate light apparatus, of the gate light apparatus being controllable by a smart home platform.

An advantage of the present gate light apparatus is that it can be quickly engaged to a gate.

Another advantage of the present gate light apparatus is that it can be engaged at a number of positions on a gate such as adjacent to an uppermost support member, such as adjacent to an intermediate support member, such as adjacent to a lowermost support member, such as adjacent to the latch side of a gate, or such as adjacent to the side of the gate having the swing axis.

Another advantage of the present gate light apparatus is that it can be fixed at a number of orientations, such as a right side up orientation, an upside down orientation, or a sideways orientation.

Another advantage of the present gate light apparatus is that batteries can be changed in the gate light apparatus without removing the gate light apparatus from the gate.

Another advantage of the present gate light apparatus is that batteries can be changed in the gate light apparatus by removing the cover portion to the housing but leaving the base portion of the housing engaged to the gate.

Another advantage of the present gate light apparatus is that the light in the gate light apparatus can be set to come on automatically when the user approaches the gate in the dark.

Another advantage of the present gate light apparatus is that it is controllable by a smart home platform.

DESCRIPTION

Figure 1:
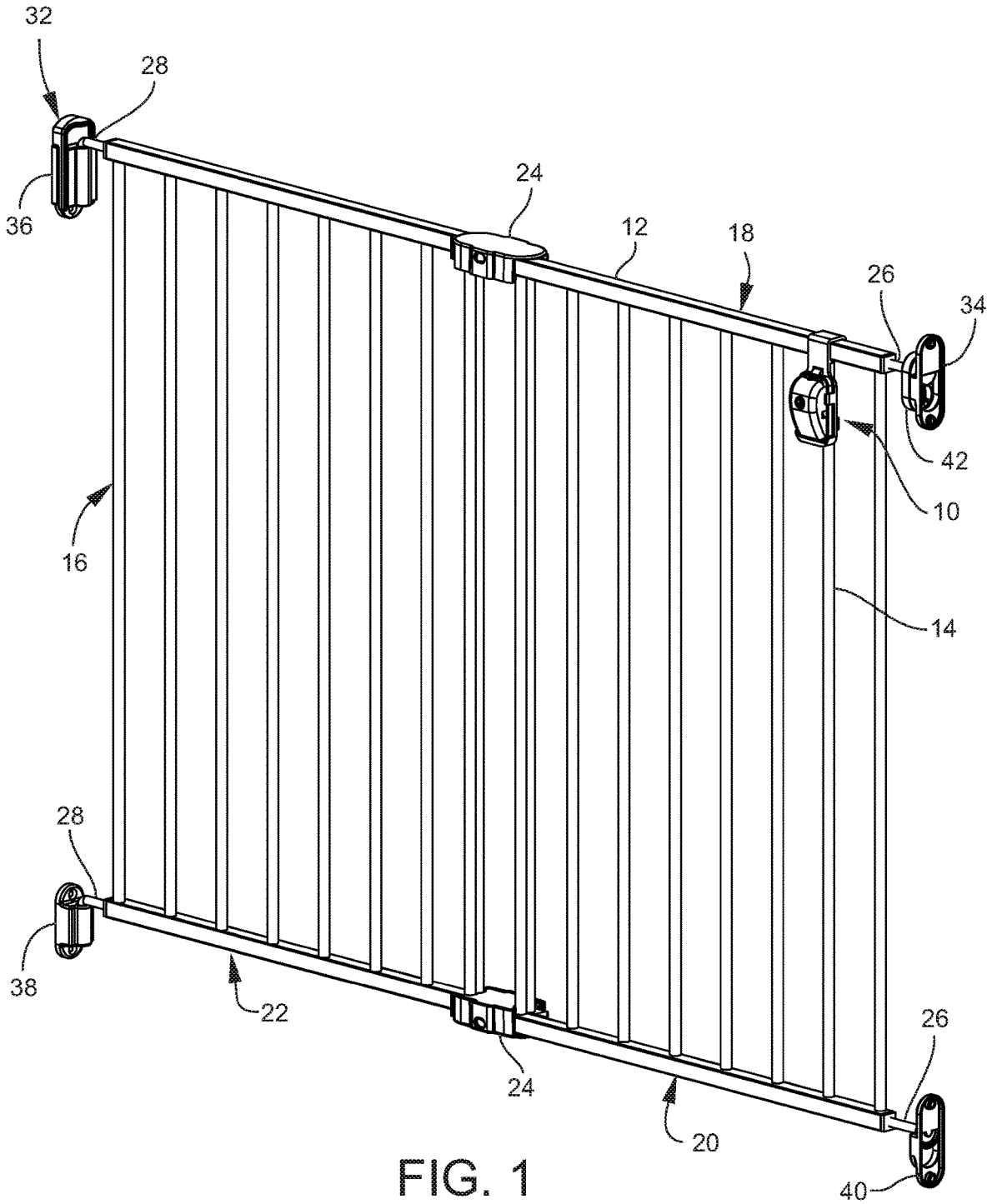
FIG. 1 is a perspective view of the present gate light apparatus engaged to a gated barrier.

As shown in FIG. 1, the present gate light apparatus is indicated by reference numeral 10. Gate light apparatus 10 is engaged to a pair of support members 12, 14 that are set at an angle to each other. Support members 12, 14 are parts of a gated barrier 16.

Gated barrier 16 includes a swinging gate 18. Swinging gate 18 includes a first gate portion 20 and a second gate portion 22 that are set in adjacent parallel planes. The first and second gate portions 20, 22 are adjustable longitudinally relative to each other by employing either an intermediate connection 24 during set up or by employing an incremental adjustment of one or both sets of vertical threaded pin pairs 26, 28.

Gate barrier 16 includes a frame 32 that mounts the swing gate 18 such that the swing gate includes a swinging axis side and a latch side. Here the frame 32 includes a set of mounts 34, 36, 38, 40 that connect the gated barrier 16 to opposing vertical surfaces such as opposing walls or opposing door jambs. In another case, the frame can include an open top U-shaped frame that extends in a direction from mount 36 to mount 38 to mount 40 to mount 34 with no framing member between mounts 36 and 34. Mounts 36 and 38 provide a swing side where the vertically extending portion of pin pairs 28 provide an axis on which that gate 18 swings. Mounts 34 and 26 provide a latching side, where latch 42 is a hook that swings away from the horizontal pin portion of pin pair 26 and whereupon all vertically extending pin portions of pin pairs 26, 28 can be lifted partially from their sockets such that the latching side of gate 18 can be disengaged and swung away from mounts 34, 40.

Figure 2:
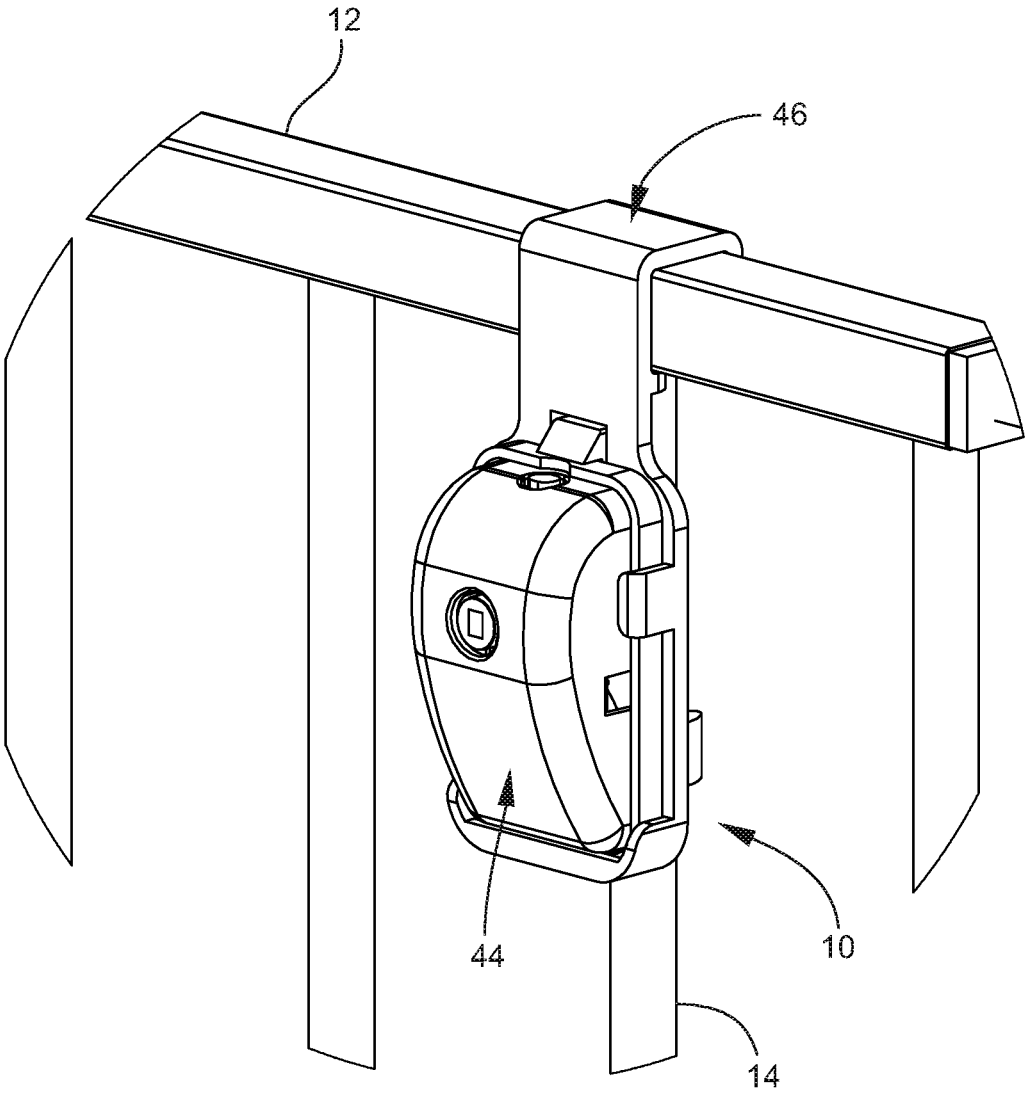
FIG. 2 is a detail perspective view of the gate light apparatus of FIG. 1 engaged to the gated barrier of FIG. 1.

FIG. 2 shows that the gate light apparatus 10 includes a light gate housing 44 and an adapter bracket 46. The housing 44 is engaged to the bracket 46 that is in turn engaged to the support members 12, 14.

Figure 3:
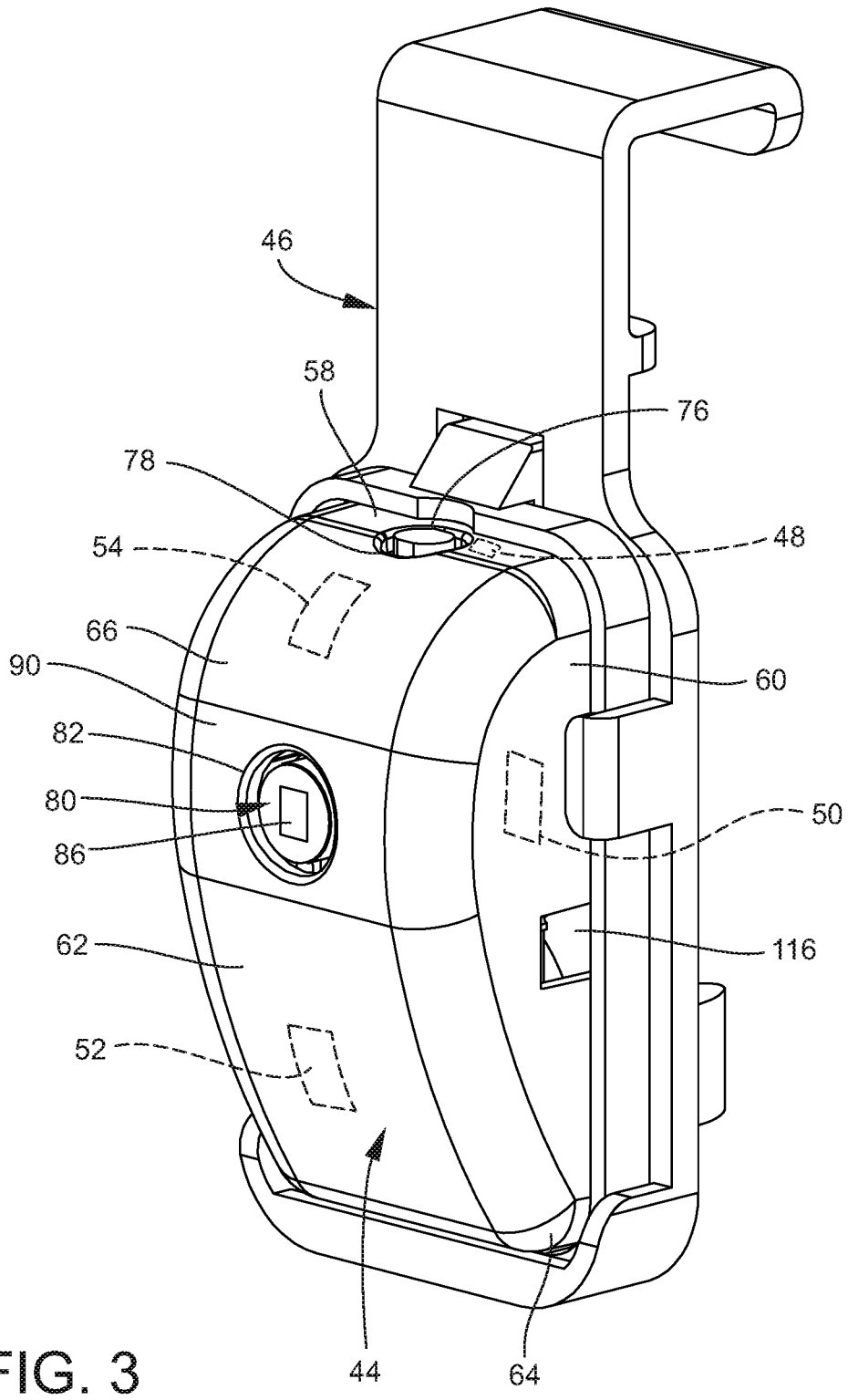
FIG. 3 is a perspective isolated partially phantom view of the present gate light apparatus showing that the gate light apparatus has a gate light housing and an adapter bracket.
Figure 4:
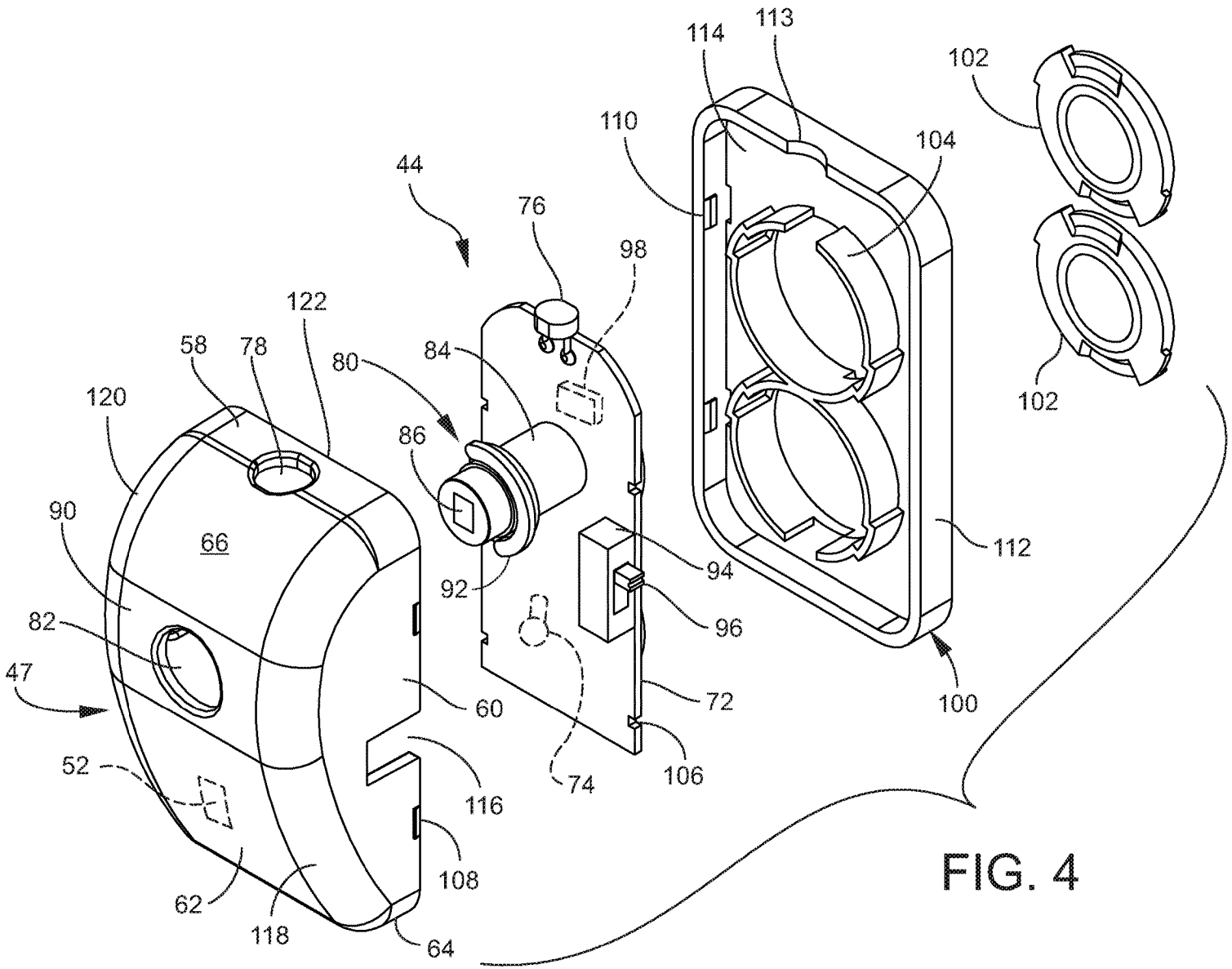
FIG. 4 is an exploded perspective partially phantom view of the gate light housing of the gate light apparatus of FIG. 3.
Figures 5A, 5B, 5C, 5D, 5E, 5F, 5G:
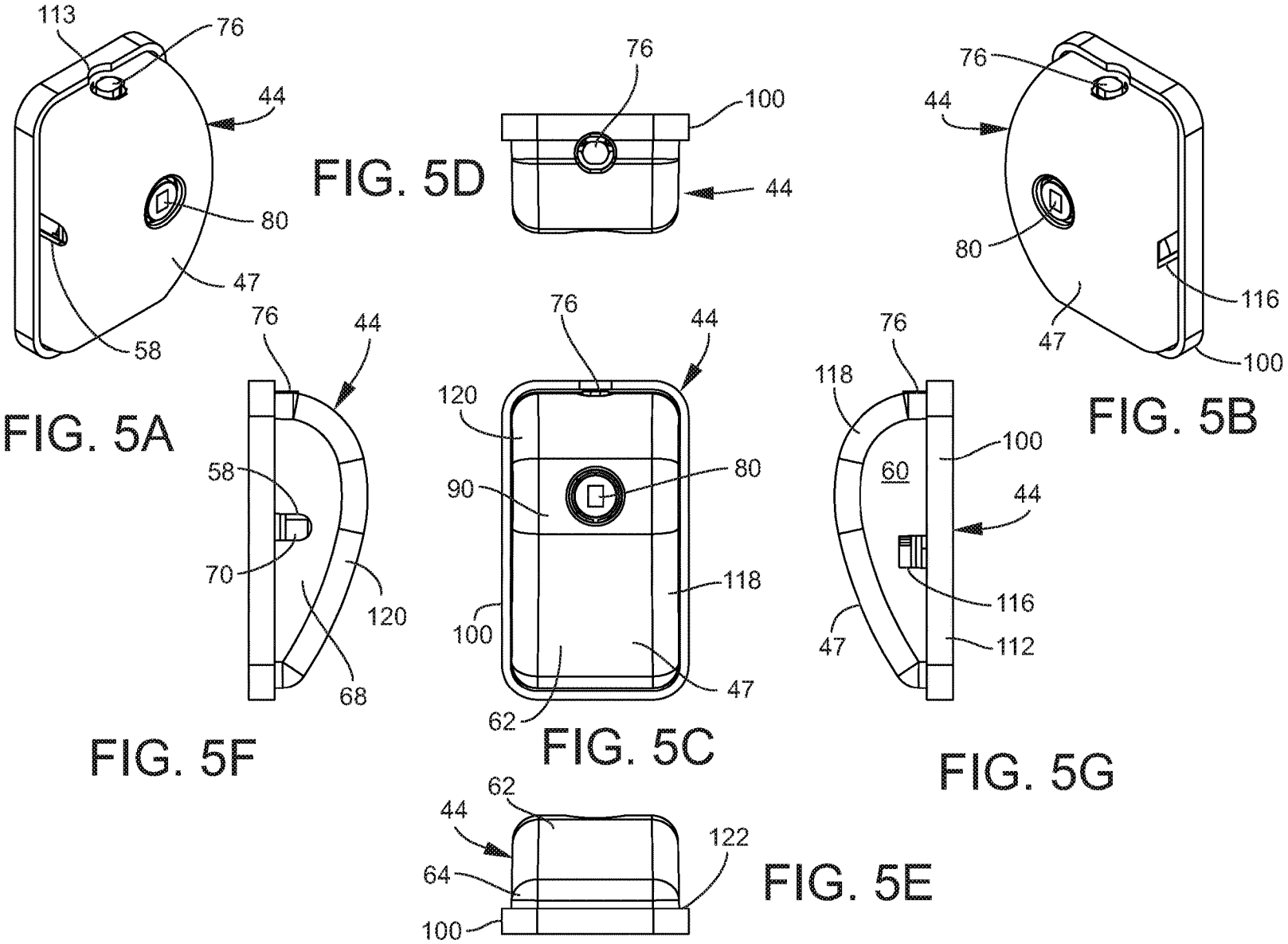
FIG. 5A is a perspective view of the assembled gate light housing of FIG. 3 from the user's left.
FIG. 5B is a perspective view of the gate light housing of FIG. 5A from the user's right.
FIG. 5C is an elevation view of the gate light housing of FIG. 5A.
FIG. 5D is a top view of the gate light housing of FIG. 5C.
FIG. 5E is a bottom view of the gate light housing of FIG. 5C.
FIG. 5F is a left side view of the gate light housing of FIG. 5C from the user's left.
FIG. 5G is a right side view of the gate light housing of FIG. 5C from the user's right.

FIG. 3 shows that the gate light housing 44 includes a housing cover 47 that may include one or more openings or windows 48, 50, 52, 54 to direct light in a desired direction. Window 48 directs light vertically and upwardly from a horizontal and top housing portion 58. Window 50 directs light horizontally to the user's right from a vertical and right side housing portion 60. Window 52 directs light downwardly and forwardly from a housing portion 62 that extends upwardly and away from a bottom 64 of the housing cover 47. Window 54 directs light upwardly and forwardly from a housing portion 66 that extends upwardly and toward the top housing portion 58 of housing cover 47. As shown in FIGS. 5A and 5F, housing cover 47 includes a window 56 that directs light horizontally to the user's right from a vertical and left side housing portion 68. The light source may be an LED source 70 engaged to a circuit board 72 secured in housing 44. LED source 70 may be engaged on the circuit board 72 in a position adjacent to window 56. For all of the other windows 48, 50, 52, 54, a respective LED source 70 may be engaged to the circuit board 72 adjacent to its respective window 48, 50, 52, 54. For example, an optional LED source 74 is shown in FIG. 4 engaged to the circuit board 72 at a position adjacent to optional window 52.

FIG. 3 further shows a photo sensor 76 for detecting light or the absence of light and an opening 78 in the housing cover 44 into which the photo sensor 76 may at least partially extend. Opening 78 is formed partially in top housing portion 58 and partially in housing portion 66. To protect the photo sensor 76, the top of the photo sensor 76 extends to a point adjacent to and slightly beyond a plane defined by the exterior surfaces of housing portions 58 and 66 that are adjacent to opening 78. A first portion of such plane is horizontal and defined by housing portion 58 and a second portion of such plane tapers upwardly and toward the top 58 of housing cover 47 and is defined by housing portion 66. Photo sensor 76 is engaged to circuit board 72.

FIG. 3 further shows an infrared motion detector 80 adjacent to an opening 82 in housing cover 47. Motion detector 80 includes base 84 secured to the circuit board 72 and a sensing portion 86 that is disposed adjacent to opening 82. Opening 82 is formed in a front middle portion 90 of housing cover 47 between housing portions 62 and 66. Base 84 may have a horizontal axis that is disposed at a right angle relative to a plane defined by circuit board 72. Motion detector 80 may further include a collar 92 that secures a distal end portion of the motion detector 80 to an inner housing section adjacent to opening 82. The heat sensing portion 86 includes a distal end or tip that is disposed inwardly of a plane defined by exterior surface sections of housing portion 90 that are adjacent to opening 82.

Circuit board 72 includes a first control apparatus 94 having a manually operated three position switch 96. At a first position, switch 96 is off (open). In this position, light source 70 or 74 or any other light source does not cast light. At a second position, switch 96 is on (closed). In this position light source 70 or 74 or any other light source does cast light. At a third position, switch 96 is set to automatic. In this position there are two conditions for any of the light sources 70 or 74 or any other light source to cast light. These two conditions are 1) darkness or relative darkness and 2) motion or relative motion. When both of these conditions are met, the light source 70 or 74 or any other light source casts light. Light source 70 or 74 or any other light source that does cast light will not cast light after a timer engaged to the circuit board 72 opens (turns off) an internal switch, with the circuit board 72 keeping closed (keeping on) internal switches to the motion detector 80 and photo sensor 76 such that light may be cast subsequently automatically.

Circuit board 72 may have supporting electronic apparatus 98 for one or more smart home platforms such as Google Assistant™, Google Home™, Amazon Alexa™, Apple Homekit™, where such platforms are disclosed in the following U.S. patent references that are hereby incorporated by reference in their entireties: 1) the Burks et al. U.S. Patent Application Publication No. US 2015/0350031 A1 issued Dec. 3, 2015 and entitled Accessory Management System Using Environmental Model, 2) the Typrin et al. U.S. Pat. No. 9,641,954 B1 issued May 2, 2017 and entitled Phone Communication Via A Voice-Controlled Device, 3) the Bruck et al. U.S. Pat. No. 9,652,976 B2 issued May 16, 2017 and entitled Mobile User Interface For Event Notifications Arising From Smart-Home Hazard Detection Devices, and 4) the Matsuoka et al. U.S. Patent Application Publication No. 2015/0061859 A1 issued Mar. 5, 2015 and entitled Security Scoring In A Smart-Sensored Home. Such a smart home platform, housed in an apparatus physically separate from gate light apparatus 10, may communicate wirelessly with supporting electronic apparatus 98 to perform one or more of the following steps: 1) internally setting control apparatus 94 to any of the first, second, or third position regardless of where switch 96 is physically located, and 2) internally overriding any step or steps performed by any of the first, second, or third positions regardless of where switch 96 is physically located such that one or more of the following steps may be performed: a) turning on or turning off the gate light source 70 or 74 or any other gate light source when the user voices such a command, b) turning on or turning off the motion detector 80 when the user voices such a command, c) turning on or turning off the photo sensor when the user voices such a command, d) turning electronically or physically by an internal physical mechanism the switch 96 to any one of the first, second, or third positions when the user voices such a command, e) turning on or turning off the wireless connection between the smart home platform and the gate light apparatus 10, and f) setting such steps of turning for a period of time voiced by the user. Further, the user may voice and the support electronic apparatus 98 may follow one or more of the following steps of g) regulating the intensity of the light cast, h) regulating the sensitivity of the motion detector 80, and i) regulating the sensitivity of the photo sensor 76. If desired, housing 44 can include a speaker, microphone, and voice activation features that function independently of a smart home platform.

The exploded view of FIG. 4 shows the housing cover 47, the circuit board 72, a base 100, and power source covers 102. Base 100 includes pockets 104 for disk shaped batteries that provide a power source for gate light apparatus 10. Circuit board 72 includes peripheral locator receivers 106 for engaging housing locators in housing cover portion 47. Housing cover portion 47 removably and snappingly engages base 100 by detent mechanisms 108 on the housing cover portion 47 cooperating with detent mechanisms 110 on the base 100. Base 100 is formed in the shape of a rectangle with a rectangular peripheral lip 112 surrounding a rectangular backing or wall 114. Lip 112 includes a semicircular cut-out 113 that is adjacent to photo sensor 76 when housing 44 is assembled. Pockets 104 are engaged to the backing 114. Side housing portion 60 includes a cut-out 116 through which manually operated switch 96 extends or is accessible. Housing cover portion 47 includes a curving transition housing portion 118 between side housing portion 60 and housing portions 64, 62, 90, 66, and 58. Housing cover portion 47 includes a curving transition housing portion 120 between side housing portion 60 and housing portions 64, 62, 90, 66, and 58. Housing cover portion 47 includes an inner rectangular peripheral edge portion 122 that is set inside of the rectangular lip 112 of base 100. Circuit board 72 may be referred to or may include a controller, computer, processor, or microprocessor.

Figure 6:
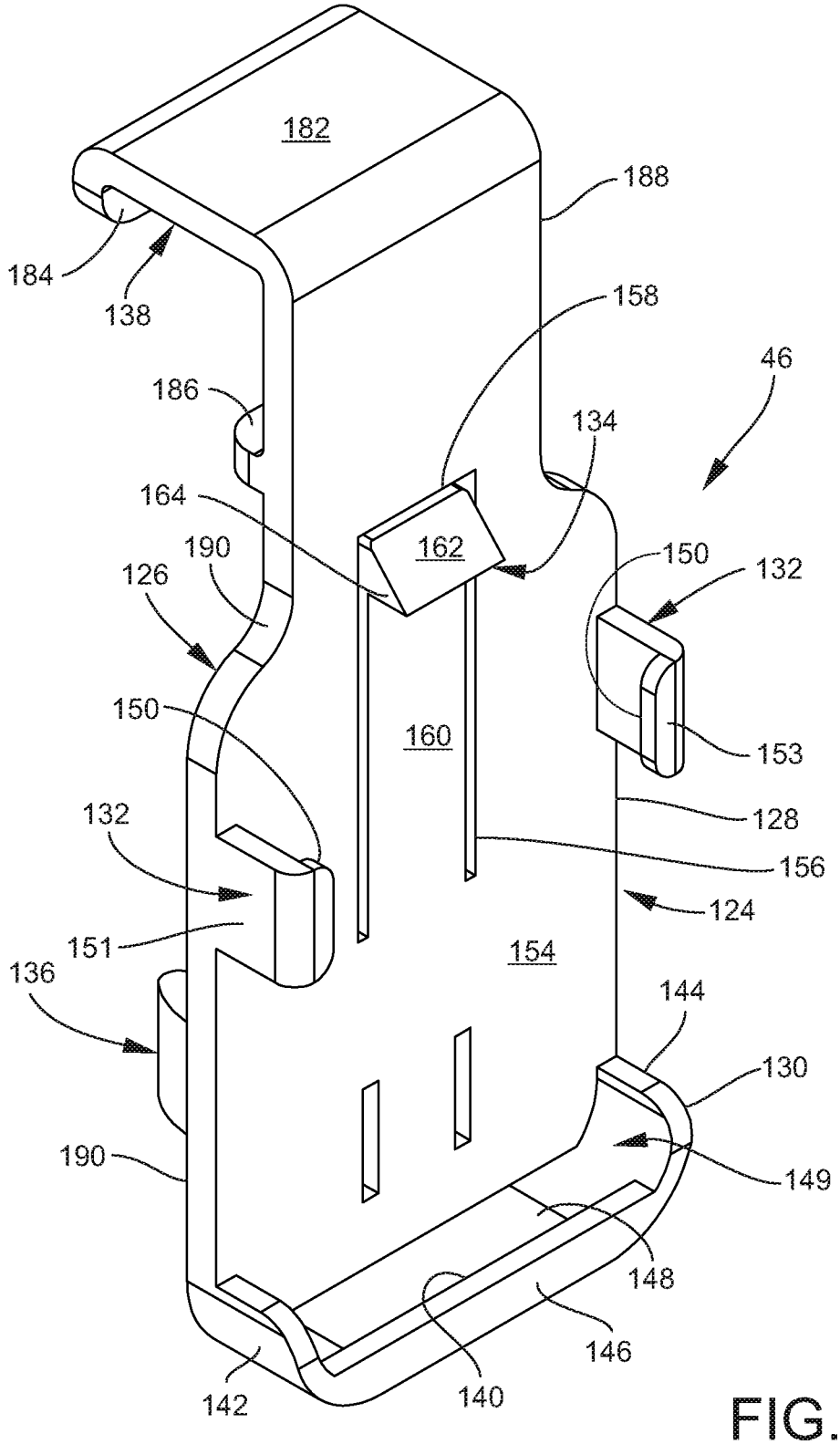
FIG. 6 is a perspective view of the adapter bracket of FIG. 3 from the user's right.
Figure 7:
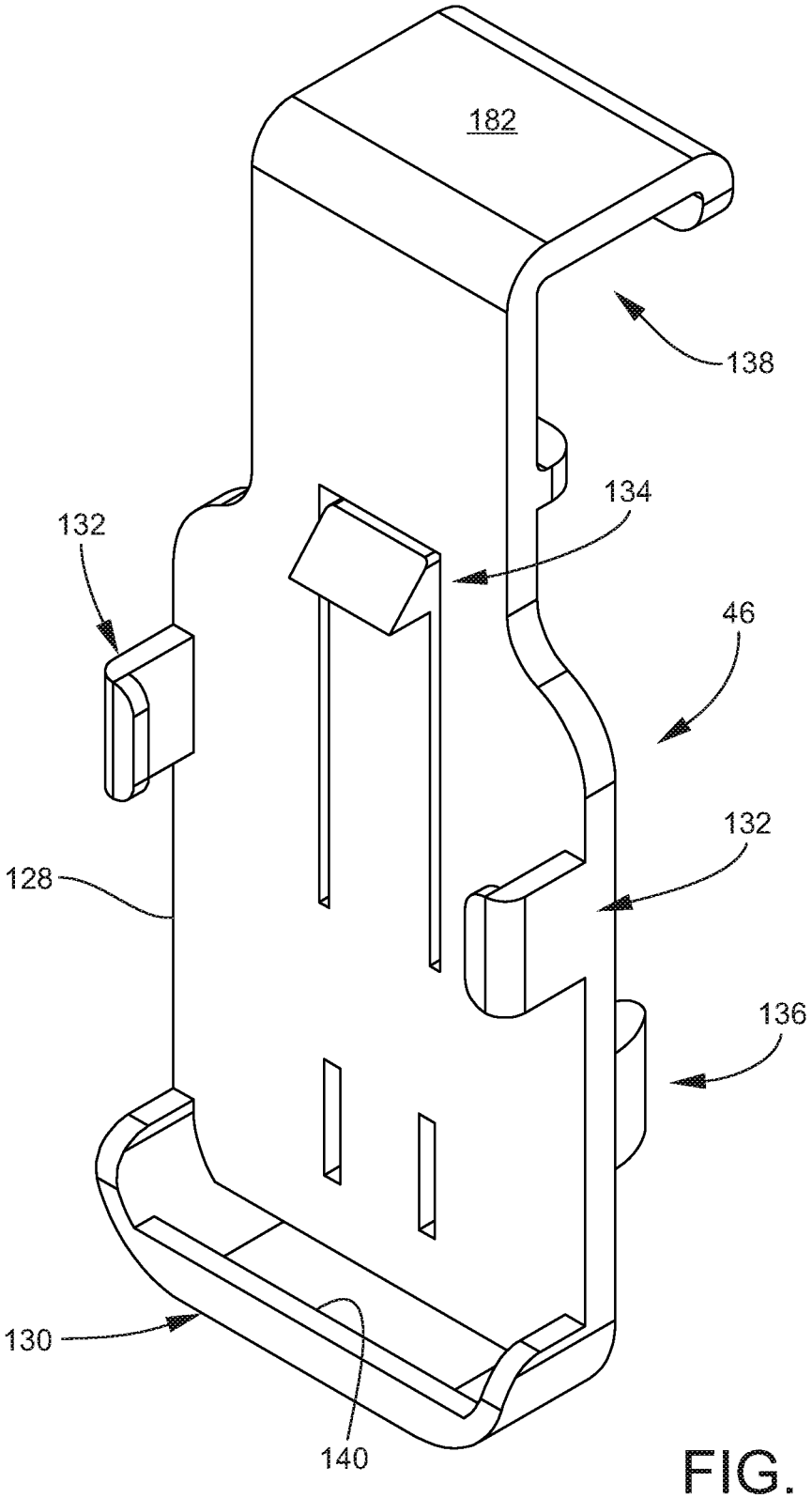
FIG. 7 is a perspective view of the adapter bracket of FIG. 6 from the user's left.
Figure 8:
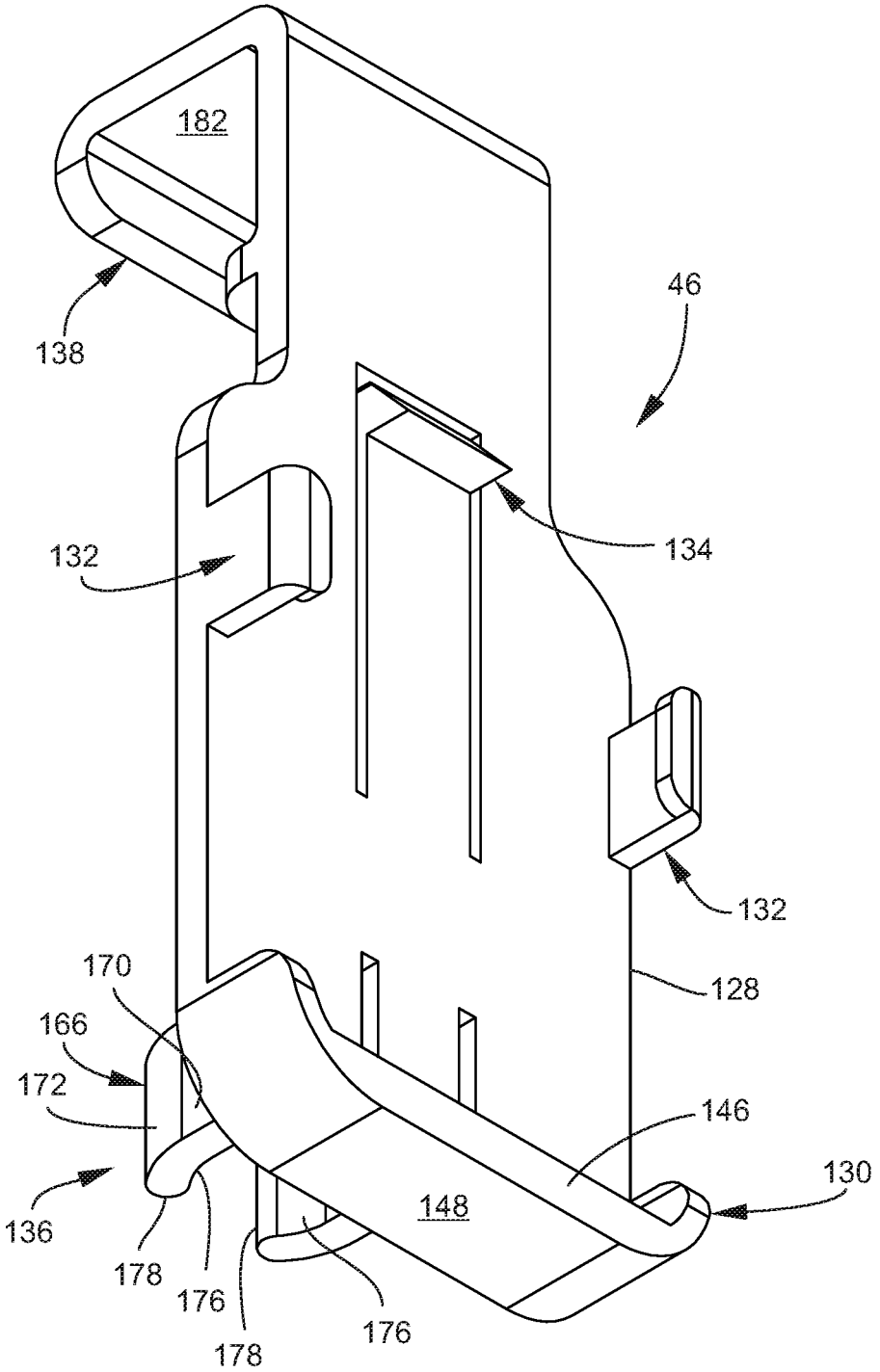
FIG. 8 is a perspective view of the adapter bracket of FIG. 6 from slightly below and the user's right.
Figure 9B:
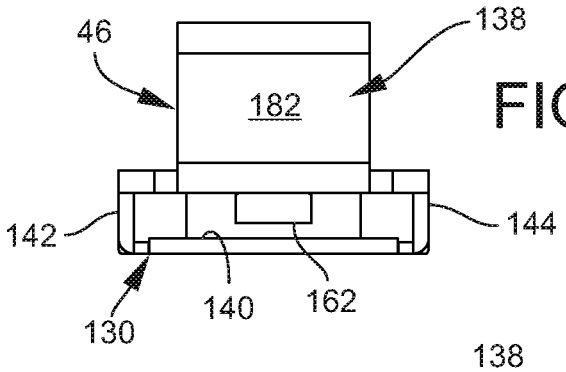
FIG. 9B is a top view of the adapter bracket of FIG. 9A.
Figure 9A:
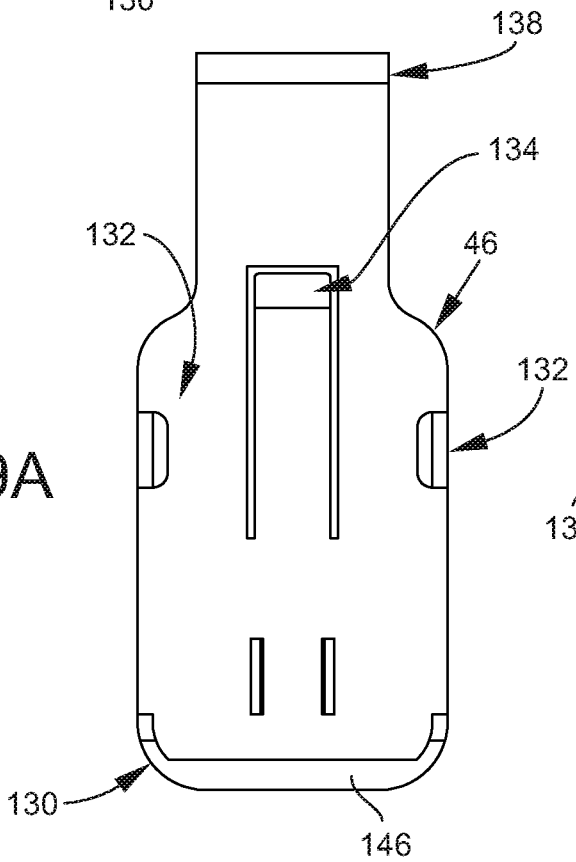
FIG. 9A is an elevation view of the adapter bracket of FIG. 6.
Figure 9D:
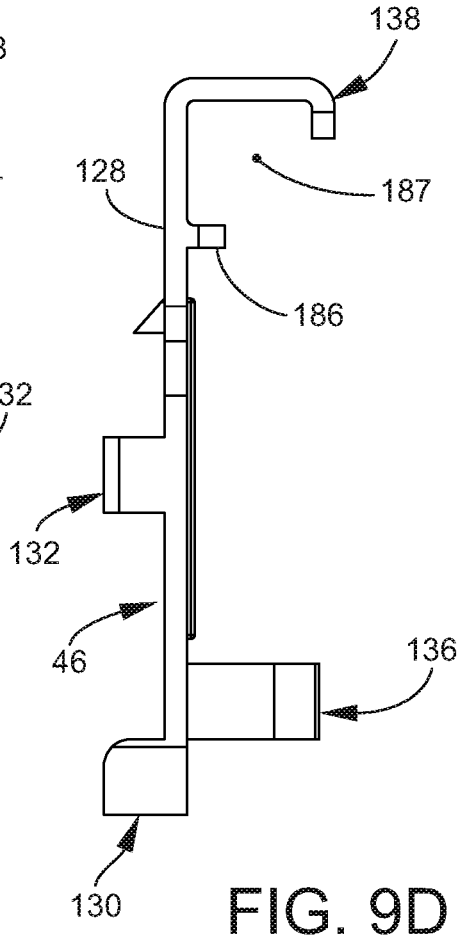
FIG. 9D is a right side view of the adapter bracket of FIG. 9A from the user's right, with the left side view being of mirror image of the right side view of FIG. 9D.
Figure 9C:
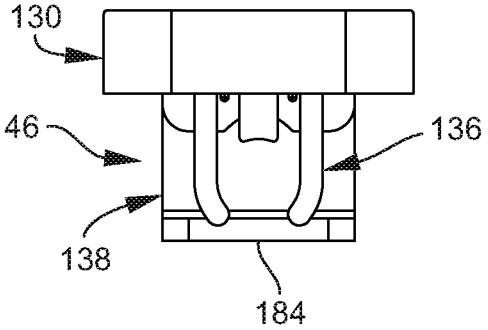
FIG. 9C is a bottom view of the adapter bracket of FIG. 9A.
Figure 10:
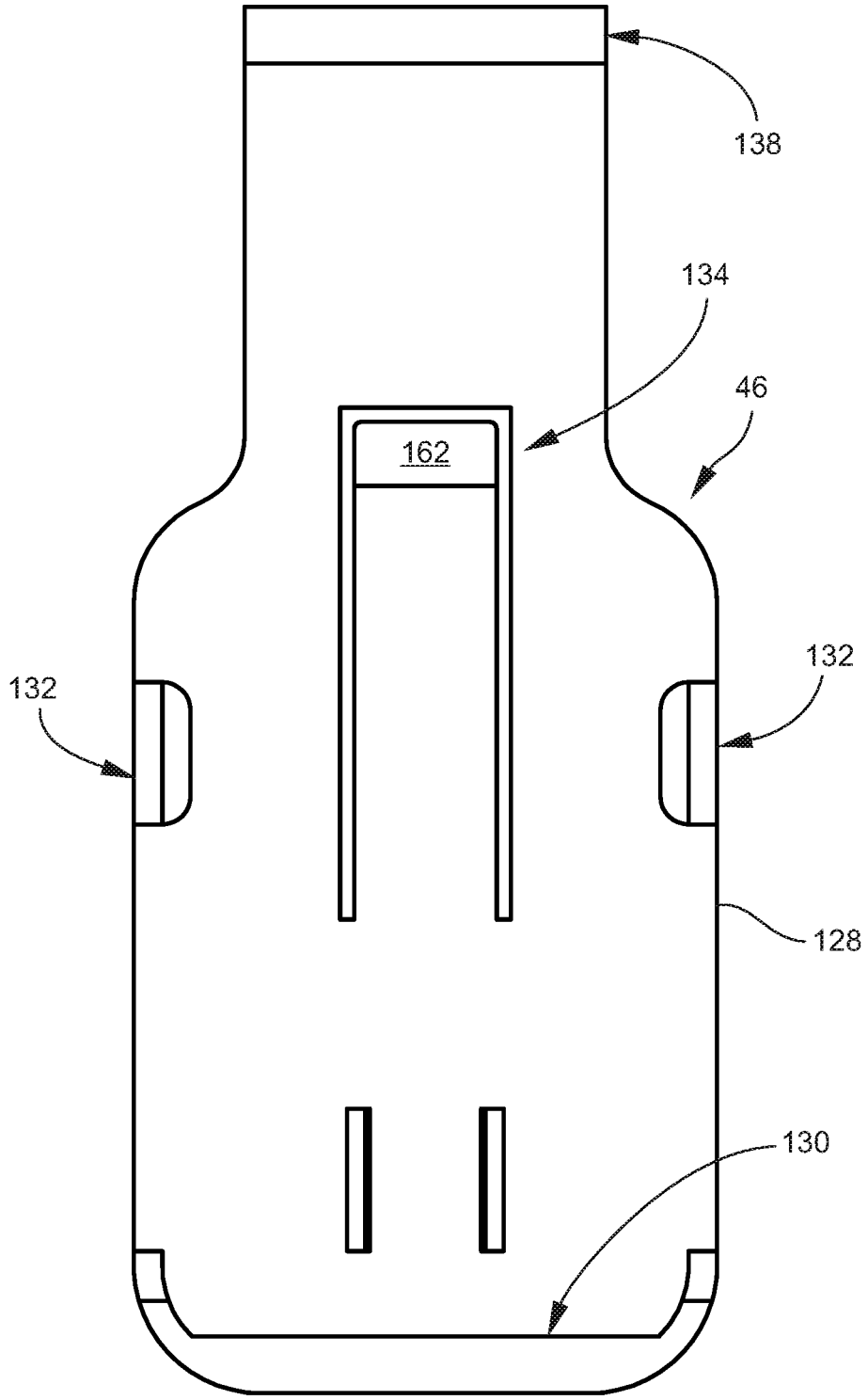
FIG. 10 is an enlarged view of FIG. 9A.
Figure 11:
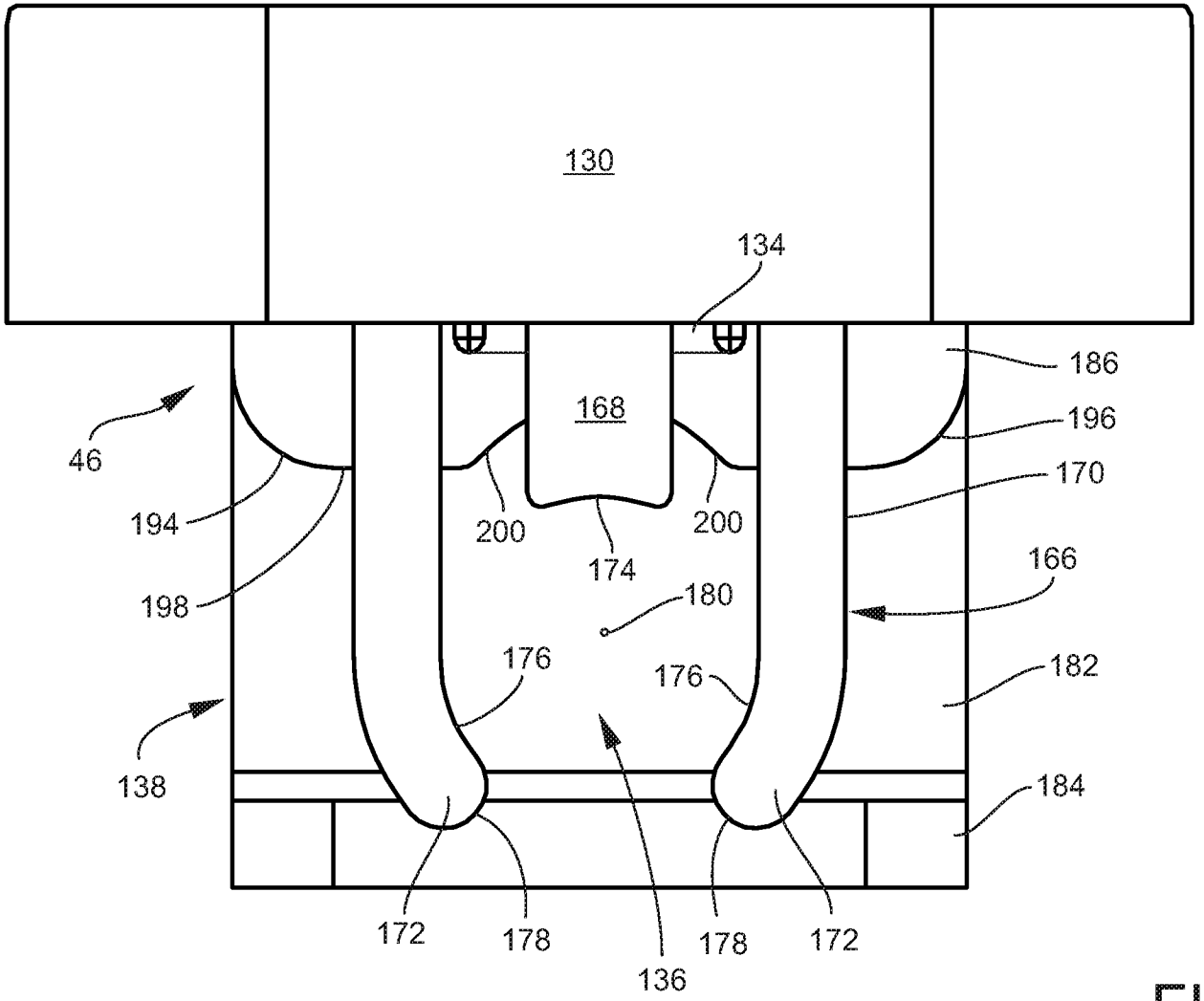
FIG. 11 is an enlarged view of FIG. 9C.
Figure 12:
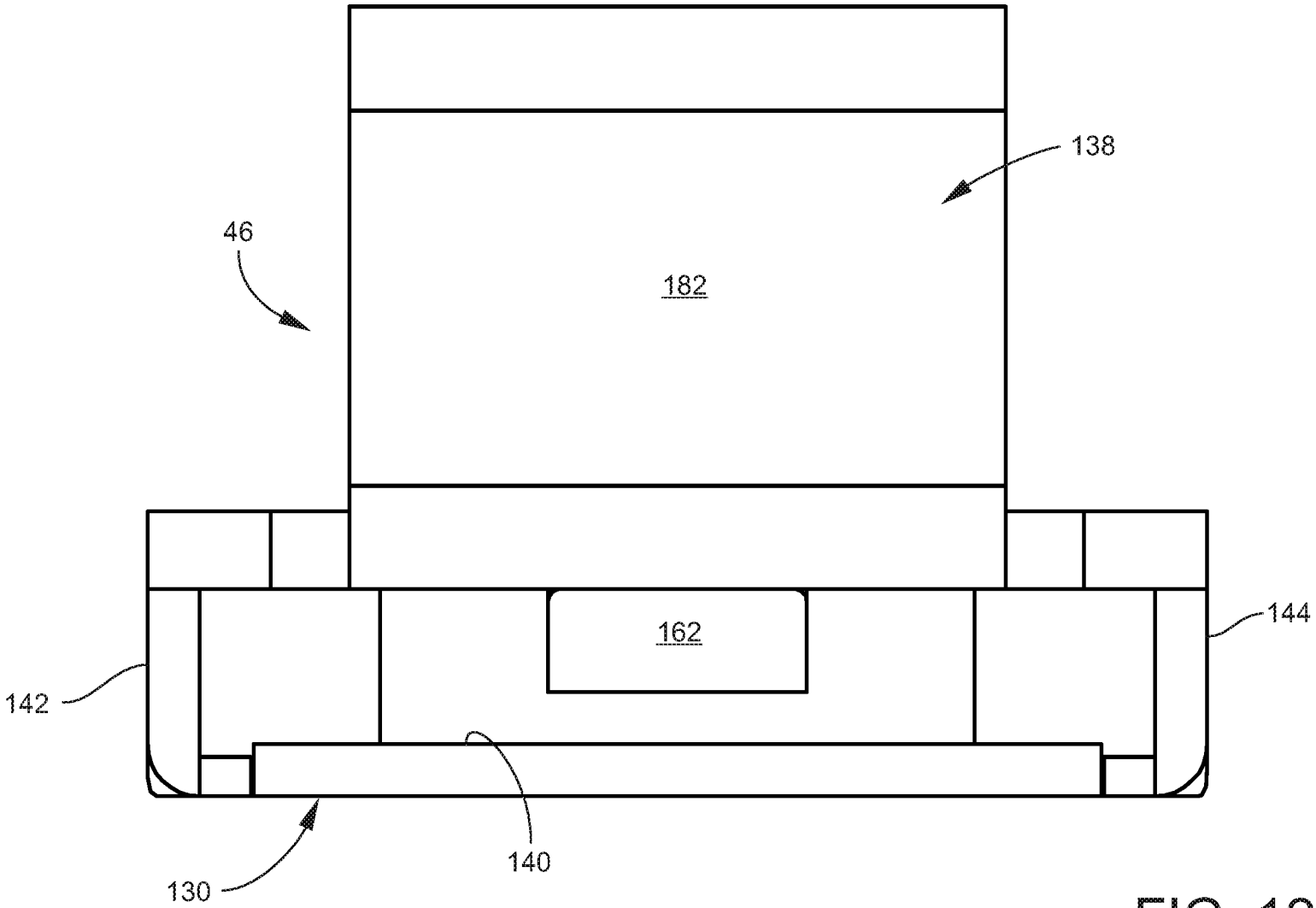
FIG. 12 is an enlarged view of FIG. 9B.
Figure 13:
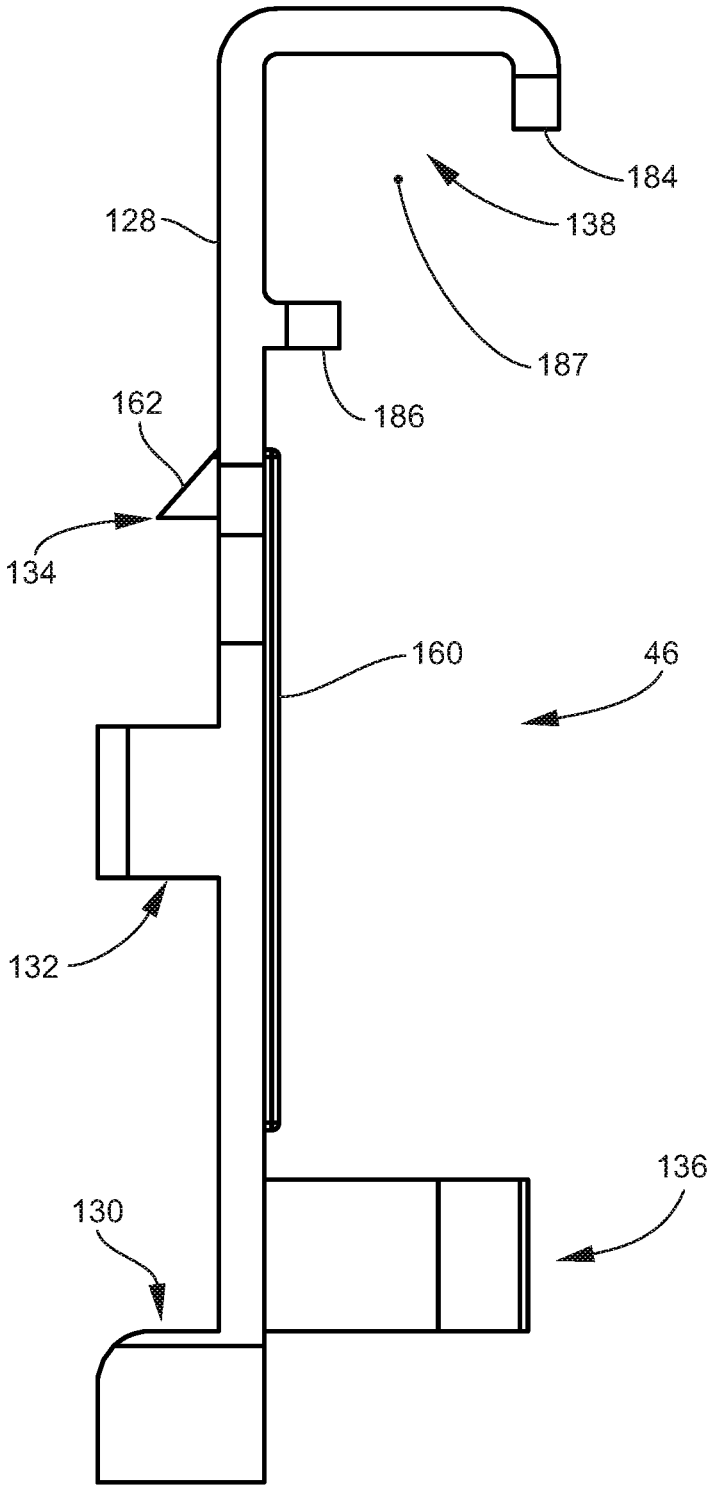
FIG. 13 is an enlarged view of FIG. 9D.

FIG. 6 shows the adapter bracket 46. Bracket 46 includes a front side 124 and a back side 126. The housing 44 is engaged to the front side 124 of the bracket 46 and the bracket 46 engages support members 12 and 14 on the back side 126 of the bracket 46. Bracket 46 is integral and one-piece.

Bracket 46 includes a base 128 separating the front side 124 from the back side 126, a cradle 130 for engaging a bottom portion of the housing 44, resilient side arms 132 for resiliently engaging side portions of the housing 44, a resilient barb 134 for resiliently engaging a top portion of the housing 44, a resilient lower support member receiver 136 configured to snappingly and resiliently engage vertical support member 14, and a resilient upper support member receiver 138 configured to snappingly and resiliently engage horizontal support member 16.

Figure 16:
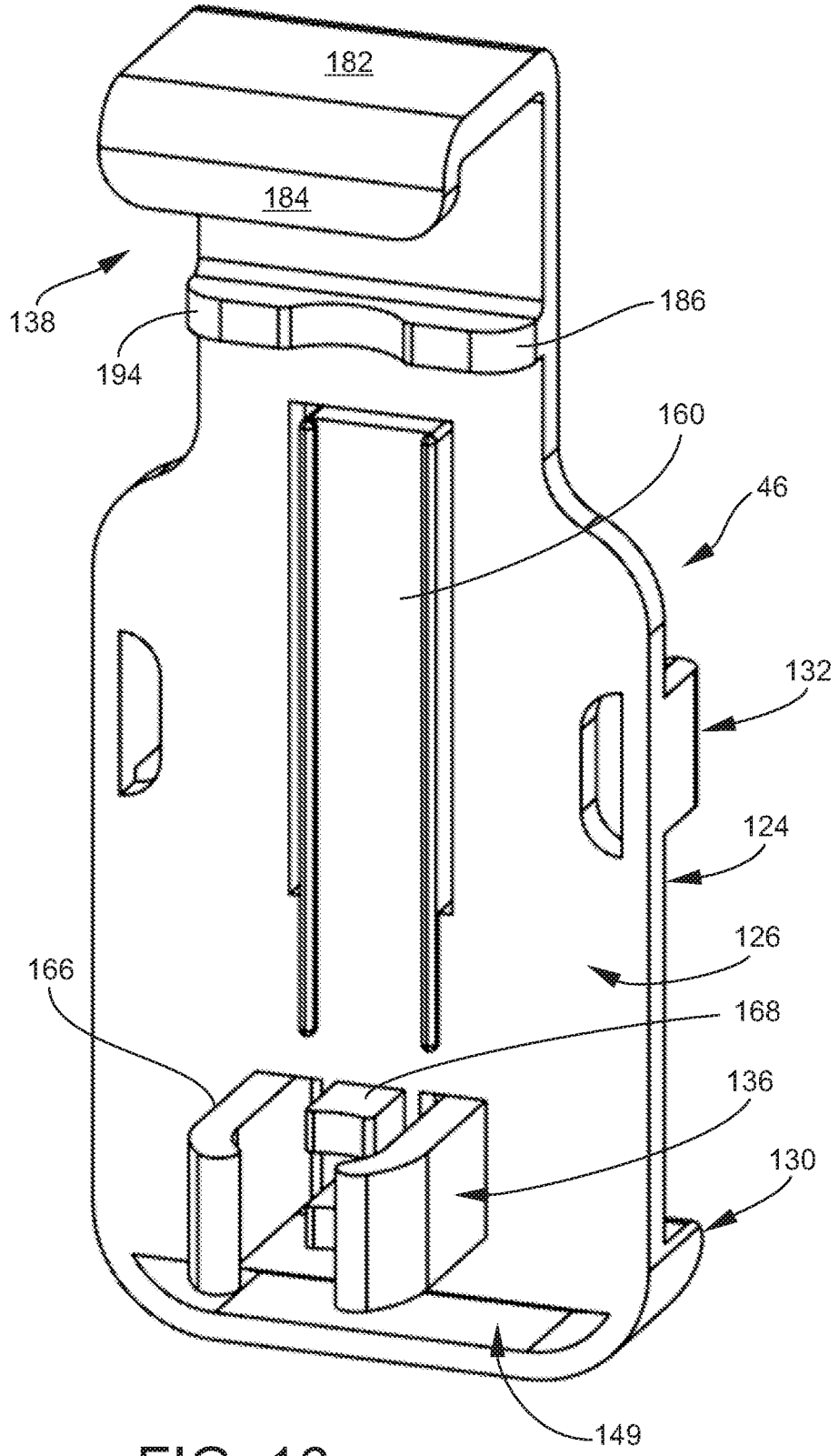
FIG. 16 is a perspective rear view of the adapter bracket of FIG. 6.
Figure 17:
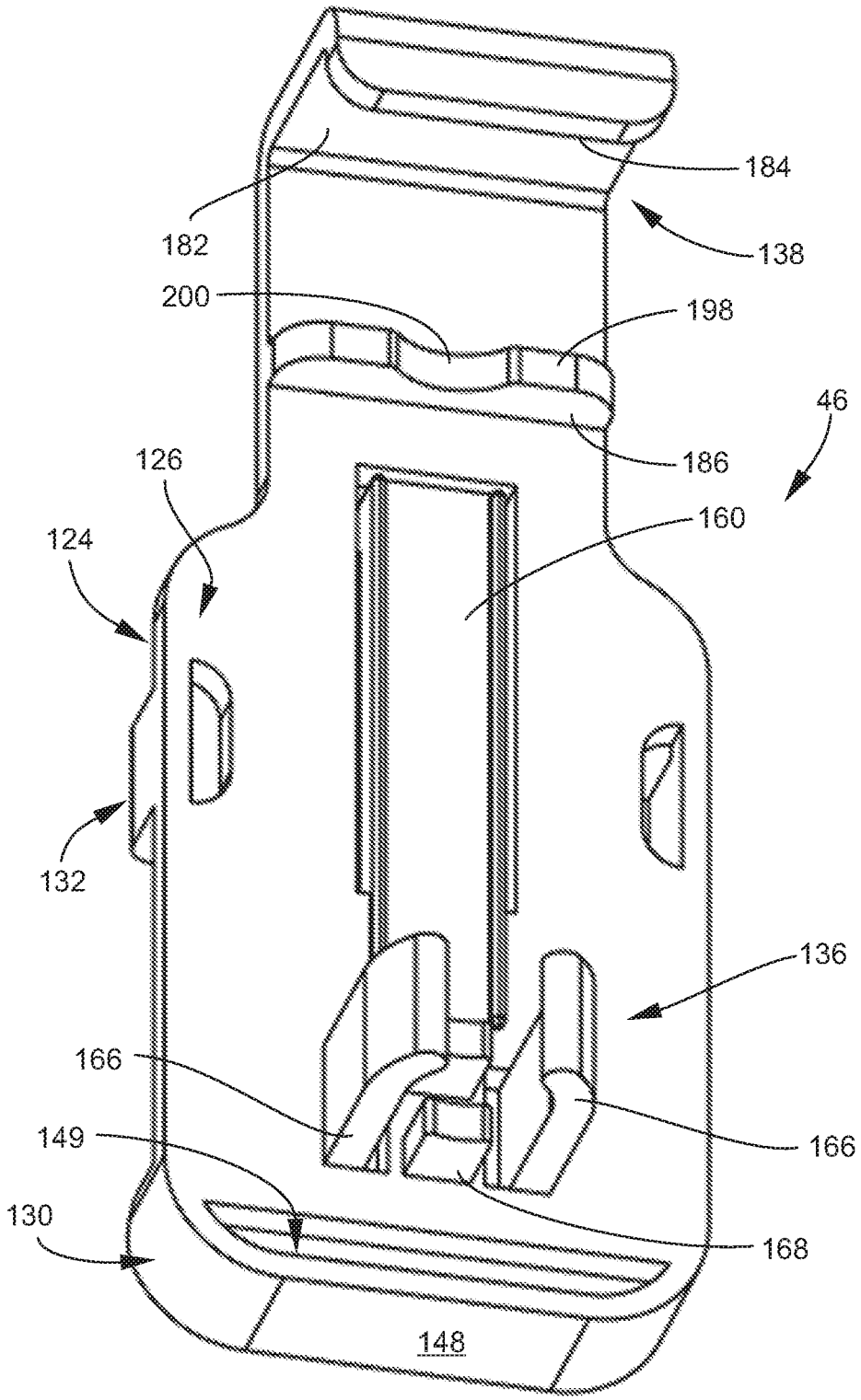
FIG. 17 is a perspective rear view of the adapter bracket of FIG. 16 from a vantage point slightly below the adapter bracket.

Bracket 46 is configured to engage housing 44 such that housing cover 44 can be removed without removing the entirety of the housing 44 from the bracket 46. Cradle 130 includes a straight laterally extending retaining ridge 140 that engages the bottom edge of the rectangular lip 112 of the housing backing 114. The inner face of the ridge 140 confronts and abuts the outer face of the lip 112 of the backing 100 and the upper face of the ridge 140 confronts and abuts the housing cover portion 47. Ridge 140 is spaced from base 128. Ridge 140 is disposed between tapering, curved side portions 142, 144 of cradle 130 and below upper edges of the side portions 142, 144. Ridge 140 extends inwardly from a front wall 146 of cradle 130. Front wall 146 extends to and between side portions 142, 144. Ridge 140 is spaced from a floor 148 of the cradle 130. Upper edges of side portions 142, 144 curve downwardly to front wall 146. Cradle 130 is configured to follow the curvature and other dimensions, such as the height of lip 112, of a bottom portion of base 100. Cradle 130 is configured to permit housing cover portion 147 to be lifted away from backing 114 while the backing 114 remains engaged to the bracket 46. As shown in FIGS. 6, 16, and 17, the floor 148 of cradle 130 is spaced from the lower edge of the base 128 to form an opening 149. The opening 149 extends from the front side 124 to the rear side of the adapter bracket 46. The opening 149 runs to and between the side portions 142, 144 of the cradle 130.

Side arms 132 are L-shaped. Each of the side arms 132 has a vertically extending retaining ridge 150. Retaining ridge 150 is turned inwardly and at a right angle relative to a base portion 152 of side arm 132. Base portion 151 includes an outer surface that is flush with a vertical side edge of base 128 such that the body of base portion 151 extends from a vertically and laterally extending face 154 of base 128. Base portion 151 includes an inner face that opposes the other side arm 132 and the retaining ridge 150 extends beyond such inner face. Such inner face of the base portion 151 confronts and abuts the side surface of lip 112. Retaining ridge 150 includes an inner vertically running face that opposes the face 154 of base 128. Such face confronts and abuts the edge of lip 112. Retaining ridge 150 includes an outside face 153. If desired, outside face 152 can be ramped inwardly and toward a central vertical portion of base face 154 to permit the backing 114 of housing 44 to force side arms 132 to expand outwardly to cover the case where the user chooses to push housing 44 between the side arms 132. Retaining ridge 150 includes an inner edge that opposes the other side arm 132. Such edge confronts and abuts housing portion 47. One or more of the base portion 151 and retaining ridge 150 is resilient such that side arms 132 can flex laterally when the housing 44 is pushed between the side arms 132.

Barb 134 is flexible rearwardly from base face 154 by virtue of through slots 156 extending through base 128. Slots 156 are vertically extending and communicate through a horizontal slot 158. In combination, slots 156, 158 form a continuous uninterrupted U-shaped slot that forms a flexible portion 160 of elongate base 128. Flexible portion 160 is integral and one-piece with elongate base 128. Barb 134 extends forwardly from a top section of flexible portion 160. Barb 134 includes an inclined, oblique wall 162 that is oblique relative to base face 154. Barb 134 includes a horizontally extending, width-wise extending, and laterally extending lower retaining face 164. Face 164 confronts and abuts the peripheral outer face of lip 112.

Housing 44 may be engaged to adapter 46 in a first way. The first way is to position a bottom portion of the housing 44, such as a bottom portion having the junction of the backing 114, against the oblique face 162 of the barb 134 to force the barb 134 rearwardly. Then the housing 44 is pushed downwardly such that the outer edge of the lip 112 slides under and confronts and abuts the inner face of the retaining ridges 150. Then the housing 44 is pushed still further downwardly until the inner edge of the retaining ridge 140 of cradle 130 engages the edge of lip 112, whereupon barb 134 snaps forwardly such that wall 164 abuts and confronts the now upper face of lip 112. In this position, since housing cover portion 47 is engaged inwardly of lip 112, the housing cover portion 47 can be snappingly and resiliently removed from base 100 without disengaging the housing 44 from the adapter 46. To disengage the housing 44, the inclined face 162 of the barb 134 is pushed rearwardly and the housing 44 is drawn out of the cradle 130 and side arms 132 in a vertical fashion. In this first way, the housing 44 is being inserted into an open pocket or cage or partial cage formed by the flexible barb 134, side arms 134, cradle 130, and base 128.

The housing 44 may be engaged to adapter 46 in a second way. First, housing 44 is placed obliquely in the cradle 130 such that lip 112 is inwardly of ridge 140 and engaged by ridge 140. Then the housing 44 is tilted rearwardly to confront and about faces 153 of the side arms 132 to force the side arms 132 to flex outwardly. Then the floor 114 or the junction of the backing 114 or floor 114 and lip 112 at a top portion of the housing 44 forces portion 160 to flex rearwardly and pop back when the floor 114 is adjacent to the base face 154. In this position, since housing cover portion 47 is engaged inwardly of lip 112, the housing cover portion 47 can be snappingly and resiliently removed from base 100 without disengaging the housing 44 from the adapter 46. To disengage the housing 44 in the reverse of the second way to engage, the barb 134 is pushed rearwardly and the side arms 132 are pushed out manually with the user's fingers to allow the user to lift the housing 44 out of the cradle 130 in an oblique fashion.

Lower support member receiver 136 includes two resilient inwardly turned and inwardly curved prongs 166. Lower support member receiver 136 further includes a pair of central projections 168, where each of the projections 168 is disposed in a horizontal first plane, is disposed equidistantly between bases 170 of the prongs 166, and is spaced from the bases 170 of the prongs 166. Bases 170 of the prongs 166 are straight and contained in a vertical second plane. Such first and second planes are disposed at right angles to each other. A rear edge 174 of central projection 168 is curved to receive a curved exterior surface of vertically extending cylindrical support member 14. Rear edge 174 is set sufficiently rearwardly to provide space for the rear face of barb containing portion 160 to flex prior to the rear face of portion 160 hitting the vertical support member 16. Inner surface portions 176 of distal ends 172 are curved to receive the curved exterior surface of vertically extending cylindrical support member 14. Outer end surfaces 178 of distal ends 172 are curved to force prongs 166 apart as the adapter 46 is snappingly pushed onto vertical cylindrical support member 16. Surfaces 176 and 174 define an axis 180. When adapter 46 is engaged to support member 16, axis 180 is coaxial with the axis of support member 16. Lower support member receiver 136 extends from a rear face of elongate base 128 at an altitude above cradle 130. Cradle 130 is disposed at the lowermost portion of elongate base 128.

The upper support member receiver 138 is disposed above the altitude of the barb 162 such that the barb 162 can flex rearwardly without hitting the horizontally extending support member 14. Upper support member receiver 138 captures three edges of the rectangular upper support member 14: an upper front edge, an upper rear edge, and a lower front edge. Upper support member receiver 138 confronts and abuts all four faces of the rectangular upper support member 14: the upper face, the front face, the rear face, and the lower face. Rearwardly extending plate portion 182 extends rearwardly, laterally and horizontally from a topmost portion of elongate base 128 to confront and abut the upper face of the horizontal support member 14. Downwardly extending ridge 184 extends downwardly, at a right angle to plate portion 182, and from a rear section of plate portion 182 to confront and abut the rear face of the horizontal support member 14. A junction of plate portion 182 and ridge 184 confronts and abuts the upper rear edge of support member 14. A junction of plate portion 182 and elongate base 128 confronts and abuts the upper front edge of support member 14. A lower and rearwardly extending ridge 186 extends rearwardly from a portion of elongate base 128 disposed at an altitude slightly above the top of the barb 162 to abut and confront the lower face of the support member 14. A junction of the lower ridge 186 and elongate base confronts and abuts the front lower edge of support member 14. Upper receiver 138 includes an axis 187 equidistance from all three junctions of upper receiver 138.

Plate portion 182 and lower ridge 186 extend rearwardly from a narrowed portion 188 of base 128. Base 128 includes a main portion 190 having the cradle 130, lower support member receiver 136, and the side arms 132. Base 128 includes the narrowed portion 188 having upper support member receiver 138. Flexible portion 160 having the barb 162 traverses both the main and narrowed portions 190, 188. Barb 162 itself is set at an altitude of about the altitude of the curved transitional edges 190 that extend between the main portion 190 and the narrowed portion 188. Plate portion 182 and lower ridge 186 extend laterally to have a lateral length that is the same as the lateral length of the narrowed portion 188. Lower ridge 186 includes an undulating rear edge 194 that terminates at a depth short of rear edge 174 of central projection 168. Undulating rear edge 194 includes a curved segment 196, a straight segment 198 and a U-shaped segment 200.

Figure 14:
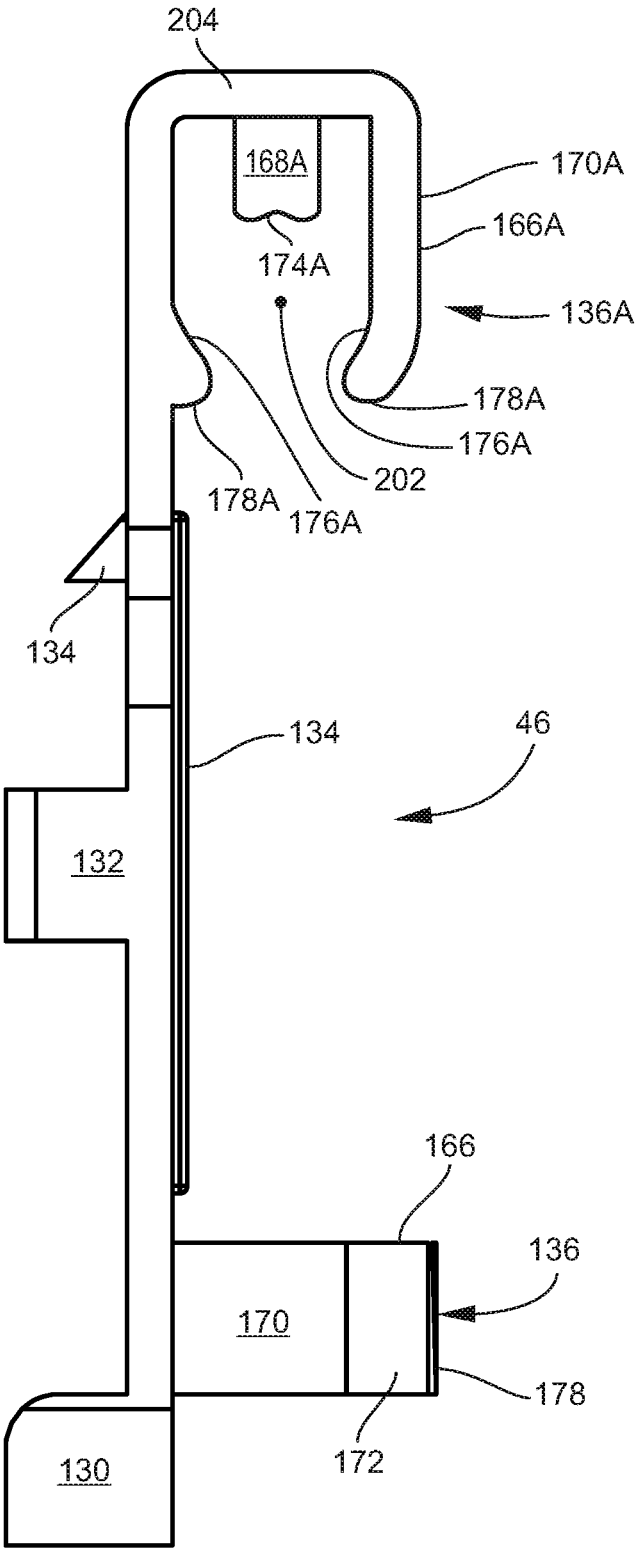
FIG. 14 is identical to the adapter bracket of FIG. 13 that engages the combination of an upper horizontal rectangular tube and vertical cylindrical tube except that the adapter bracket of FIG. 14 is configured to engage the combination of an upper horizontal cylindrical tube and vertical cylindrical tube.

FIG. 14 shows that receiver 136A can be positioned and configured to engage a horizontally extending support member that is cylindrical and has a horizontal axis 202. Receiver 136A replaces receiver 138. Plate portion 204 is in the nature of plate portion 182. An upper portion of base 128 is formed in the nature of one of the prongs 166. 170A is a base portion of prong 166A. Prong 166A includes curved surfaces 178A and 176A. Receiver 136A includes projection 168A and edge 174A. The letter "A" denotes a structure and function identical or similar to receiver 136 or to features thereof.

Figure 15:
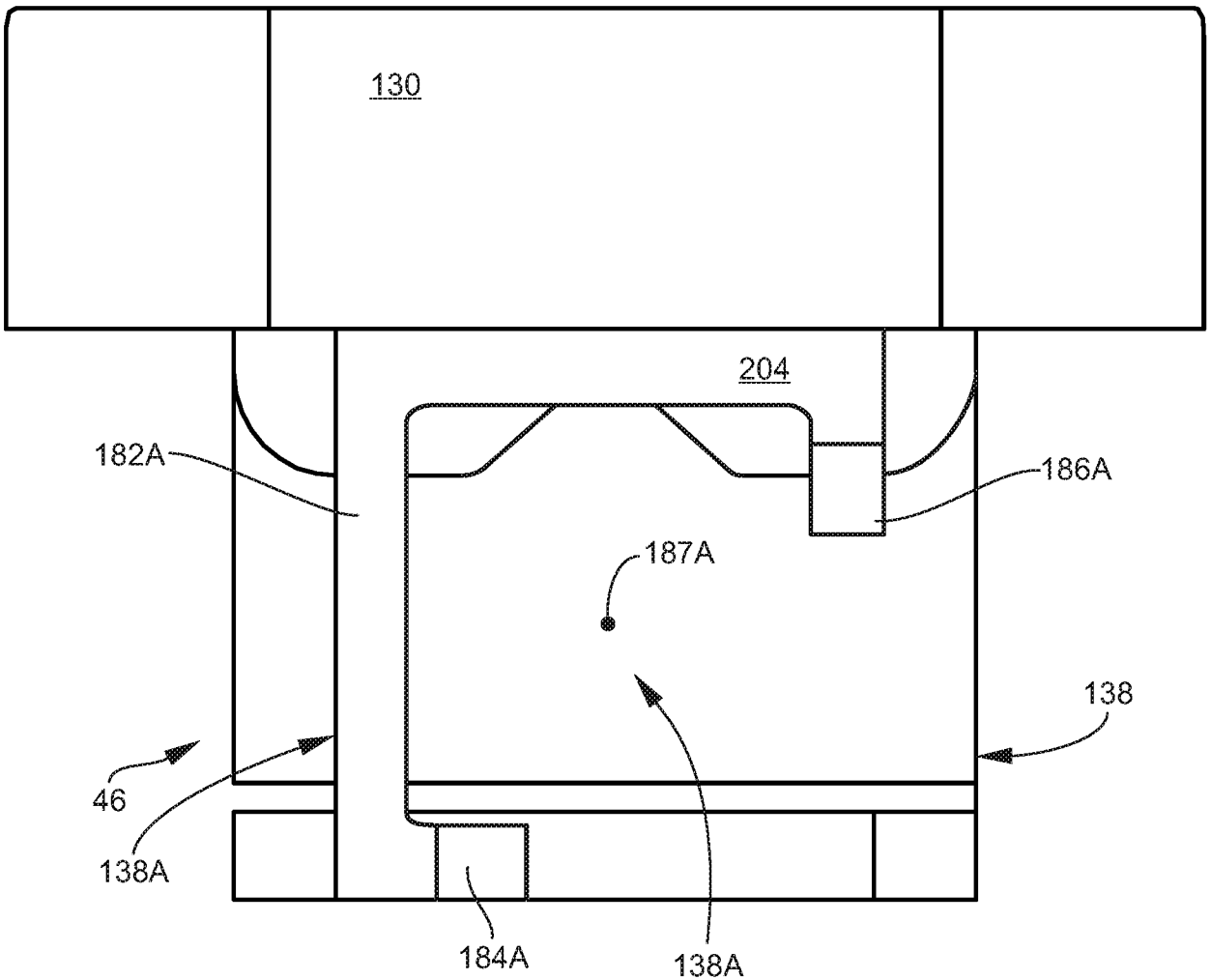
FIG. 15 is identical to the adapter bracket of FIG. 11 that engages the combination of an upper horizontal rectangular tube and vertical cylindrical tube except that the adapter bracket of FIG. 15 is configured to engage the combination of upper horizontal rectangular tube and a vertical rectangular tube.

FIG. 15 shows that receiver 138A can be positioned and configured to engage a vertically extending support member that is rectangular and has a vertical axis. Receiver 138A replaces receiver 136. Receiver 138A includes ridges 184A and 186A. Receiver 138A includes plate portion 182A. Plate portion 204 confronts and abuts a front face of a vertical support member and spaces such front face from rearwardly flexing piece 134. The letter "A" denotes a structure and function identical or similar to receiver 138 or to features thereof.

Receivers 136, 136A, 138 and 138A snappingly and resiliently engage support members.

It should be noted that adapter 46 can be configured with a) a lower receiver configured to engage a cylindrical support member (FIG. 6), a rectangular support member (FIG. 15), or a support member having a section or exterior surface of a different shape and with b) an upper receiver configured to engage a cylindrical support member (FIG. 14), a rectangular support member (FIG. 6), or a support member having a section or exterior surface of a different shape.

In operation, gate light apparatus 10 is fixed in a non-twistable state to two intersecting support members 14, 16. Gate light apparatus 10 can be snappingly and resiliently engagable to and disengagable from a swinging gate 18 or engagable to and disengagable from another structure having transversing or intersecting support members. Housing 44 is resiliently engagable to adapter bracket 46 in a vertically downward sliding fashion, whereupon the barb 134 is pushed back and then automatically springs forward. Then housing cover portion 47 is removable from its base 100, leaving the base 100 engaged to the adapter 46 and leaving the adapter 46 engaged to the support members 14, 16 to, for example, change batteries. Gate light apparatus 10 can be positioned on a front face or rear face of a gate. Gate light apparatus 10 can be positioned to cast light along a front face or along a rear face of a gate. Gate light apparatus 10 can be positioned to cast light on the latch of a gate or the latching end of a gate. Gate light apparatus 10 can be positioned to cast light on the swinging axis of a gate. Gate light apparatus 10 can be positioned to cast light on a front approach to the gate that includes the gate threshold. Gate light apparatus 10 can be positioned to cast light on a rear approach to the gate that includes the gate threshold. Since light scatters, windows 50, 52, and 58 can cast light on a gate threshold. If desired, cradle 130 can include a bottom opening in floor 148 and housing cover portion 47 can include a window in bottom housing portion 64 or peripheral edge portion 122, where such bottom opening and such window are aligned or communicate with each other, such that gate light apparatus 10 can cast light directly on the portion of the threshold directly below the gate light apparatus 10. Gate light apparatus 10 can be turned upside down where receiver 138 engages the lowest-most support member of a gate or where receiver 138 engages an intermediate support member of a gate. Gate light apparatus 10 can be turned on its side such that receiver 138 engages a vertically extending support member and receiver 136 engages a horizontally extending support member.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A gate light apparatus for connection to first and second support members disposed at an angle relative to each other, comprising:

a) a housing;

b) the housing having a motion detector, a photo sensor, a light source, and a power source;

c) a bracket having a rear side and a front side;

d) the rear side of the bracket having a first receiver configured to engage the first support member and a second receiver configured to engage the second support member;

e) the first receiver including a first axis, the second receiver including second axis, the first and second axis being set at a right angle relative to each other;

f) the front side of the bracket configured to engage the housing;

g) the housing including a base and a cover;

h) the cover of the housing removably engaged to the base of the housing;

i) the base of the housing having a periphery and the cover of the housing engaged to the base inwardly of the periphery;

j) the front side of the bracket being configured to engage the base without engaging the cover such that the cover is removable from the base without removing the base from the bracket;

k) wherein the front side of the bracket includes an open pocket that engages the base;

l) the open pocket including opposing side arms extending frontwardly of the base and having inwardly turned ridges that engage the base without engaging the cover;

m) the open pocket including a cradle extending frontwardly of the base that engages the base without engaging the cover, the cradle spaced from the opposing side arms; and n) the open pocket including an upper end having a flexible barb extending forwardly that engages the base without engaging the cover, the flexible barb being resiliently flexible rearwardly to be disengaged from the base.

2. The gate light apparatus of claim 1, wherein the first receiver is configured to receive a support member having a cylindrical cross section and the second receiver is configured to receive a support member having a rectangular cross section.

3. The gate light apparatus of claim 1, wherein the first receiver is configured to receive a support member having a rectangular cross section and the second receiver is configured to receive a support member having a cylindrical cross section.

4. The gate light apparatus of claim 1, wherein the first receiver is configured to receive a support member having a cylindrical cross section and the second receiver is configured to receive a support member having a cylindrical cross section.

5. The gate light apparatus of claim 1, wherein the first receiver is configured to receive a support member having a rectangular cross section and the second receiver is configured to receive a support member having a rectangular cross section.

6. The gate light apparatus of claim 1, wherein the motion detector includes a sensing portion having a distal end disposed inwardly of a plane of a surface of the housing.

7. The gate light apparatus of claim 1, wherein the photo sensor includes a distal end disposed adjacent to a plane of a surface of the housing.

8. The gate light apparatus of claim 1, wherein the gate light apparatus is controllable by a smart home platform.

9. A gate light apparatus for connection to first and second support members disposed at an angle relative to each other, comprising:

a) a housing;

b) the housing having a motion detector, a photo sensor, a light source, and a power source;

c) a bracket having a rear side and a front side;

d) the rear side of the bracket having a first receiver configured to engage the first support member and a second receiver configured to engage the second support member;

e) the first receiver including a first axis, the second receiver including second axis, the first and second axis being set at a right angle relative to each other;

f) the front side of the bracket configured to engage the housing;

g) the housing including a base and a cover;

h) the cover of the housing removably engaged to the base of the housing;

i) the base of the housing having a periphery and the cover of the housing engaged to the base inwardly of the periphery;

j) the front side of the bracket being configured to engage the base;

k) wherein the front side of the bracket includes an open pocket that engages the base;

l) the open pocket including opposing side arms extending frontwardly of the base and having inwardly turned ridges that engage the base;

m) the open pocket including a cradle extending frontwardly of the base that engages the base, the cradle spaced from the opposing side arms; and n) the open pocket including an upper end having a flexible barb extending forwardly that engages the base, the flexible barb being resiliently flexible rearwardly to be disengaged from the base.

10. The gate light apparatus of claim 9, wherein the inwardly turned ridges engage the base without engaging the cover.

11. The gate light apparatus of claim 9, wherein the cradle engages the base without engaging the cover.

12. The gate light apparatus of claim 9, wherein the flexible barb engages the base without engaging the cover.

13. A gate light apparatus and gated barrier combination, the combination comprising:

a) a gated barrier;

b) the gated barrier having a gate and a gate latch;

c) the gated barrier having first and second support members disposed at an angle relative to each other;

d) a gate light apparatus;

e) the gate light apparatus having a housing and a bracket;

f) the housing having a motion detector, a photo sensor, a light source, and a power source;

g) the bracket having a rear side and a front side;

h) the rear side of the bracket having a first receiver configured to engage the first support member of the gated barrier and a second receiver configured to engage the second support member of the gated barrier;

i) the first receiver including a first axis, the second receiver including second axis, the first and second axis being set at a right angle relative to each other;

j) the front side of the bracket configured to engage the housing;

k) the housing including a base and a cover;

l) the cover of the housing removably engaged to the base of the housing;

m) the base of the housing having a periphery and the cover of the housing engaged to the base inwardly of the periphery;

n) the front side of the bracket being configured to engage the base;

o) wherein the front side of the bracket includes an open pocket that engages the base;

p) the open pocket including opposing side arms extending frontwardly of the base and having inwardly turned ridges that engage the base;

q) the open pocket including a cradle extending frontwardly of the base that engages the base, the cradle spaced from the opposing side arms; and r) the open pocket including an upper end having a flexible barb extending forwardly that engages the base, the flexible barb being resiliently flexible rearwardly to be disengaged from the base.

14. The combination of claim 13, wherein the inwardly turned ridges engage the base without engaging the cover, wherein the cradle engages the base without engaging the cover, and wherein the flexible barb engages the base without engaging the cover such that the front side of the bracket is configured to engage the base without engaging the cover such that the cover is removable from the base without removing the base from the bracket.

15. The combination of claim 14, wherein the gate light apparatus is controllable by a smart home platform.

* * * * *